US007987756B2

(12) United States Patent
Lewis et al.

(10) Patent No.: US 7,987,756 B2
(45) Date of Patent: Aug. 2, 2011

(54) ELECTRO-MANUAL DISPENSER

(75) Inventors: Richard Paul Lewis, Marietta, GA (US); Paul Francis Tramontina, Harleysville, PA (US); Kiran Reddy, Roswell, GA (US)

(73) Assignee: Kimberly-Clark Worldwide Inc., Neenah, WI (US)

( * ) Notice: Subject to any disclaimer, the term of this patent is extended or adjusted under 35 U.S.C. 154(b) by 389 days.

(21) Appl. No.: 11/998,897

(22) Filed: Dec. 3, 2007

(65) Prior Publication Data

US 2009/0140001 A1 Jun. 4, 2009

(51) Int. Cl.
*A47K 10/18* (2006.01)

(52) U.S. Cl. ..... 83/338; 83/337; 83/649; 83/949; 225/106

(58) Field of Classification Search ..... 83/648, 83/649, 650, 321, 322, 337, 338, 949, 734; 225/10, 15, 23, 96, 106; 242/559, 559.1, 242/564

See application file for complete search history.

(56) References Cited

U.S. PATENT DOCUMENTS

| | | | | |
|---|---|---|---|---|
| 2,738,934 | A | 3/1956 | Dobkin | |
| 4,192,442 | A | 3/1980 | Bastian et al. | |
| 4,738,176 | A | 4/1988 | Cassia | |
| 4,790,490 | A | 12/1988 | Chakravorty | |
| 4,846,035 | A | 7/1989 | Granger | |
| 5,452,832 | A | 9/1995 | Niada | |
| 6,079,305 | A | 6/2000 | Bloch et al. | |
| 6,098,917 | A | 8/2000 | Cruz | |
| 6,314,850 | B1 | 11/2001 | Morand | |
| 6,378,725 | B1 | 4/2002 | Granger | |
| 6,820,785 | B2 | 11/2004 | Kapiloff | |
| 6,826,985 | B2 | 12/2004 | Broehl | |
| 6,892,620 | B2 | 5/2005 | Kapiloff | |
| 6,903,654 | B2 | 6/2005 | Hansen et al. | |
| 7,213,782 | B2 | 5/2007 | Osborne et al. | |
| 7,222,816 | B2 | 5/2007 | Clark | |
| 2005/0145745 | A1 | 7/2005 | Lewis et al. | |
| 2007/0079684 | A1* | 4/2007 | Friesen et al. | 83/649 |
| 2007/0176041 | A1 | 8/2007 | Friesen et al. | |

FOREIGN PATENT DOCUMENTS

| | | | |
|---|---|---|---|
| JP | 2004-248867 | A | 9/2004 |

* cited by examiner

*Primary Examiner* — Phong H Nguyen
(74) *Attorney, Agent, or Firm* — Ralph H. Dean, Jr.

(57) ABSTRACT

Disclosed is a sanitary or no-touch dispenser which dispenses sheets of a web material, such as a paper towel. The disclosed dispenser provides the web material to a user by using both manual and electronic means to dispense the sheet. This is accomplished by having a motor engagably connected to an actuator roller. The motor is activated by a motor activation means, such as a switch. The motion of the actuator roller, which is started by the user grabbing and pulling a tail of the web material extending from the dispenser, causes the motor activation means to activate the motor which in turn drives the actuator roller to continue it its rotation motion to dispense the sheet from the dispenser.

22 Claims, 11 Drawing Sheets

ELECTRO-MANUAL DISPENSER

FIELD OF THE INVENTION

The present invention is directed to a dispenser for dispensing sheets from a roll of a web material, such as, for example a paper towel.

BACKGROUND OF THE INVENTION

There are a number of dispensers known in the art for dispensing and cutting sheets of paper toweling or other similar materials. These dispensers are generally divided into two types of dispensers. The first type is a dispenser which the user needs to physically contact the dispenser to dispense a sheet of the material from the dispenser. The second type of dispenser is a "sanitary" or "no-touch" dispenser. "Sanitary" or "no-touch" dispensers allow a user to obtain a sheet of the web material by only touching the web material extending from the dispenser or by activating an electronic sensor to advance the sheet material. There is no need for a user to touch any part of the dispenser in order to obtain a sheet from the dispenser.

Currently available sanitary or no-touch dispensers are operated either manually or electronically. In manual sanitary or no-touch dispensers, the process of dispensing and cutting the web material is carried out automatically by a user pulling on the free "tail" end of the web material that extends from a dispensing slot in the dispenser. In a typical configuration, the web material is engaged against a rough friction-enhancing surface of a feed drum and the action of pulling the web tail causes the drum to rotate. The drum often includes a drive mechanism and, after the initial pull on the web tail by a user, the drum is driven a predetermined rotational degree to dispense a metered amount of the web material, which is often called a "sheet". A cam driven cutting mechanism may be provided in the rotating drum that pivots out of a slot in the drum to automatically cut the web at the proper length. This type of dispenser typically includes a stored energy mechanism, such as an eccentric cam, that is spring loaded during the initial rotation of the feed drum. This mechanism generally provides energy to aid in cutting the sheet material from the web and causes the drum to continue to rotate after the web has been cut to form the sheet. This action causes an additional length of the web material to be fed out of the dispensing slot as the tail for the next dispensing sequence. As a result, the user only touches the tail end of the web material during dispensing of a sheet of the web material.

Although effective, the conventional manual or mechanical sanitary dispensers utilizing automatic mechanical cutting and feeding mechanisms can be relatively difficult for some users, such as young children and elderly adults, to use. For some users, these manual or mechanical dispensers present an inordinate amount of resistance to pulling a sheet of the web material from the dispenser. This may be particularly true when the initial pulling action by the user also provides the force needed to load the potential energy spring of the automatic tail feeding mechanism. Further, the high resistance to pulling created by loading of the potential energy in the spring mechanism also means it is necessary for the web materials being dispensed from the dispensers to have a relatively high tensile strength. If the tensile strength of the web material is too low, the web will tend to tear during dispensing, which may cause the dispenser to jam. As a result, the next user will not be able to use the dispenser in a hands free mode to retrieve a sheet of the web material from the dispenser. Additionally, the torn pieces, or tabs, of the sheet material are often dropped on the floor presenting an undesired and unsightly mess on the washroom floor. Lower tensile products are desirable as they are generally softer and are more absorbent than higher tensile products.

Advances have been made in the art relating to purely electronic sanitary web material dispensers. With such dispensers, the unit is typically activated upon detection of motion of a user's arm or hand. A motor is subsequently energized through a control circuit and power source to drive a feed roll and thus dispense a measured length of the web material. The user then grabs the exposed web material and pulls the web material at some angle to the dispenser cover causing a sheet of material to be separated on a cutting edge or serrated tear bar. The cycle is repeated for the next user.

A significant drawback with electronic sanitary dispensers is that electrical power is consumed by the motor to drive the full length of towel material from the dispenser. In addition, these dispensers require a relatively high energy use to overcome the inertia of the roll of web material at rest. That is, the relatively heavy roll of the web material takes a large amount of energy to start the motion of the roll of the web material so that a length of the web is advanced in the dispenser. Dispensers having a sensor to detect motion of a user's hands or arms also require that the sensor be powered with electrical power, which creates a constant drain of the power supply. In these electronic dispensers for web materials, battery life is greatly reduced due to the high energy demands to advance the roll material and the constant drain on the battery to operate the sensor, which results in frequent battery replacement and maintenance. Other drawbacks of the electrical systems with sensors include false triggers which causes the web material to be dispensed from the dispenser unintentionally. In addition, many electronic dispensers also lack of an emergency feed when the batteries are too weak to activate the motor.

There is a need in the art for a sanitary or no-touch web material dispenser which overcomes the problems of the manual and electrical sanitary or no-touch dispensers noted above.

SUMMARY OF THE INVENTION

Generally stated, the present invention provides a dispenser for dispensing a roll or a web material to a user in need of the web material. The dispenser of the present invention uses both manual energy provided by a user of the dispenser and electrical energy supplied to a motor, which in turn rotates the actuator roller to dispense a measured length of a web material, called a "sheet", from the dispenser.

A dispenser within the scope of the present invention is for dispensing sheets from a roll of a web material. In one embodiment of the present invention, the dispenser has a housing which forms a compartment, and a holder for supporting a roll of a web material within the compartment. The dispenser also has a cutting blade contained within an actuator roller; the actuator roller is rotationally mounted in the compartment and has a rotational path. The cutting blade is extendable from the actuator roller at a predetermined location in the rotational path of the actuator roller and retractable at a second predetermined location in the rotational path of the actuator roller. The cutting blade is extended to cut the web material to form a sheet of the web material to be dispensed from the dispenser. The dispenser also has a motor engagably connected to an actuator roller and a motor activation means, wherein the motor activation means activates the motor at or just before the first predetermined location of the rotational path and deactivates the motor at or near the second predetermined location of the rotational path. The second predetermined location is generally just after the actuator roller has rotated a sufficient distance to deliver a "tail" of a sheet material outside the dispensing slot for the next user.

In a second embodiment of the present invention, provided is a dispenser for dispensing sheets from a roll or a web material. The dispenser has a housing, a compartment with the housing, a holder for supporting a roll of a web material located within the compartment. The dispenser of this embodiment also has a dispensing actuator roller which is rotatably mounted within the compartment. This actuator roller has a rotational path to advance the web material through the dispenser. To cut the web material, a cutting blade cuts the web material at a predetermined location in the rotational path of actuator roller to form a sheet of the web material to be dispensed from the dispenser. The cutting blade may be located within the actuator roller or may be positioned in a different roller. A motor engagably connected to the actuator roller and the motor is connected to a motor activation means. The motor activation means activates the motor at a first predetermined location of the rotational path of the actuator roller and deactivates the motor at a second predetermined location of the rotational path of the actuator roller. The second predetermined location is generally just after the actuator roller has rotated a sufficient distance to deliver a "tail" of a sheet material outside the dispensing slot for the next user.

In further embodiments of the present invention, each embodiment of the present invention described above may have additional features such as a power supply connected to the motor. Generally, the motor activation means may be a switch, including for example, a spring loaded switch.

In further embodiments of the present invention, the dispensers may have at least one shaft extending from one end of the central axis of the actuator roller. This shaft may have an actuator roller drive is positioned thereon. The actuator roller drive may have a raised portion and an unraised portion where the raised portion being designed to contact the motor activation means to activate the motor and the unraised portion contacts the motor activation means in a way to deactivate the motor. The actuator drive roller may have gear like structure thereon. The gear structure of the actuator roller drive may encompass less that the entire circumference of the actuator roller drive.

In another embodiment of the present invention, the motor of the dispensers may have a shaft and this shaft generally will have a motor drive wheel attached to the shaft. The motor drive wheel may have a gear structure which will directly or indirectly contact the gear structure that is present on the actuator drive.

In yet a further embodiment of the dispensers of the present invention, the dispensers may have an emergency feed knob located on the same axis as the actuator roller. This emergency feed knob may be used to engage the actuator roller in the event that power is not available to the motor. Generally the emergency feed knob is disengaged from actuator roller during normal operation, but may be engagable with the actuator roller for emergency feeding.

In further embodiments of the present invention, a roll of web of a material is positioned in the holder such that the web material is dispensable from the dispenser. In another embodiment of the present invention, the dispenser may further have a web material identification means, which identifies the web material positioned on the holder for supporting the web material.

DEFINITIONS

Figure 1:
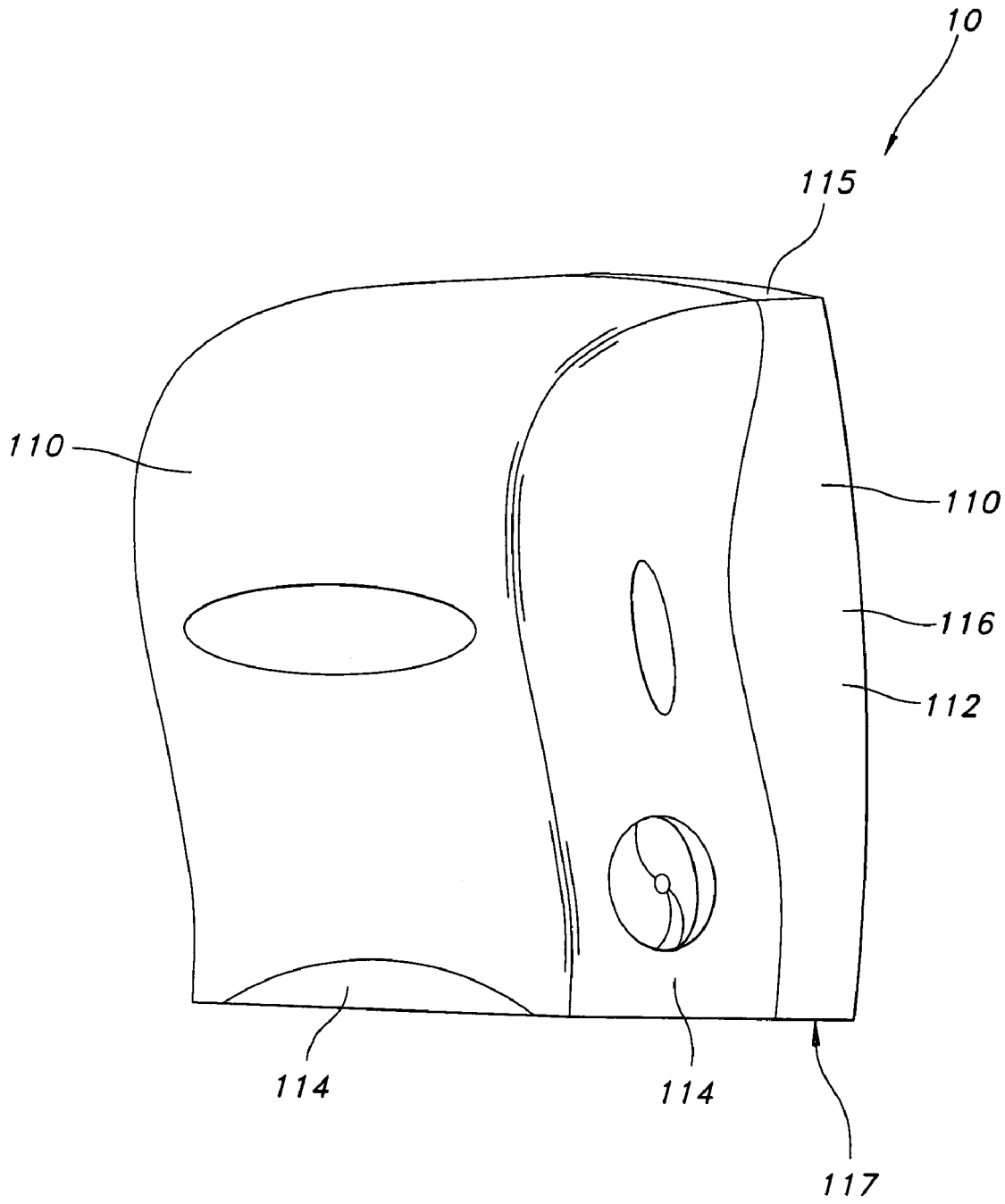
FIG. 1 shows an exterior perspective view of an embodiment of a dispenser according to the invention.

It should be noted that, when employed in the present disclosure, the terms "comprises", "comprising" and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As used herein, the term "sheet" means a defined length of web material dispensed from the dispenser.

As used herein, the term "web material" means the material which is to be dispensed from the dispenser of the present invention prior to forming a sheet. The web material may be rolled onto a roll or may be partially unwound from the roll.

DETAILED DESCRIPTION OF THE INVENTION

In the following detailed description of the present invention, reference is made to the accompanying drawings which form a part hereof, and which shows by way of illustration, specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the present invention. The following detailed description is, therefore, not to be taken in a limiting sense, and the scope of the present invention is defined only by the appended claims, along with the full scope of equivalents to which such claims are entitled.

The dispenser of the present invention is generally used for dispensing a rolled web material. Such rolled web material may include, but is not limited to, woven materials, nonwoven materials, synthetic materials, natural materials, foils, polymer films, any combination thereof, and so forth. The rolled web material is dispensed from the dispenser as a defined length sheet of the web material cut or otherwise removed from the roll of the web material. Specific examples of the web materials which may be dispensed from the dispenser of the present invention include, but are not limited to, absorbent sheet materials such as towels, wipers, tissue, and so forth. The web materials for which the present invention is suitable may be wound around a core (not shown). Alternatively, the web materials are wound into a coreless roll. Optionally, but not required nor preferred, the rolled web material which may be used in the dispenser of the present invention may have regularly spaced zones of weakness extending substantially across the width of the sheet material. The zones of weakness are used to separate or cut the sheet material into individual sheets and may be, for example, defined by a series of perforations, a zone of much lower basis weight, and so forth. Typically, the web material dispensed from the dispenser of the present invention does not contain a zone of weakness, since the cutting blade will cut the web material. In one particular embodiment of the present invention, the dispenser is for dispensing sheets of a paper towel from a roll of a material suitable for use as a paper towel.

Figure 2:
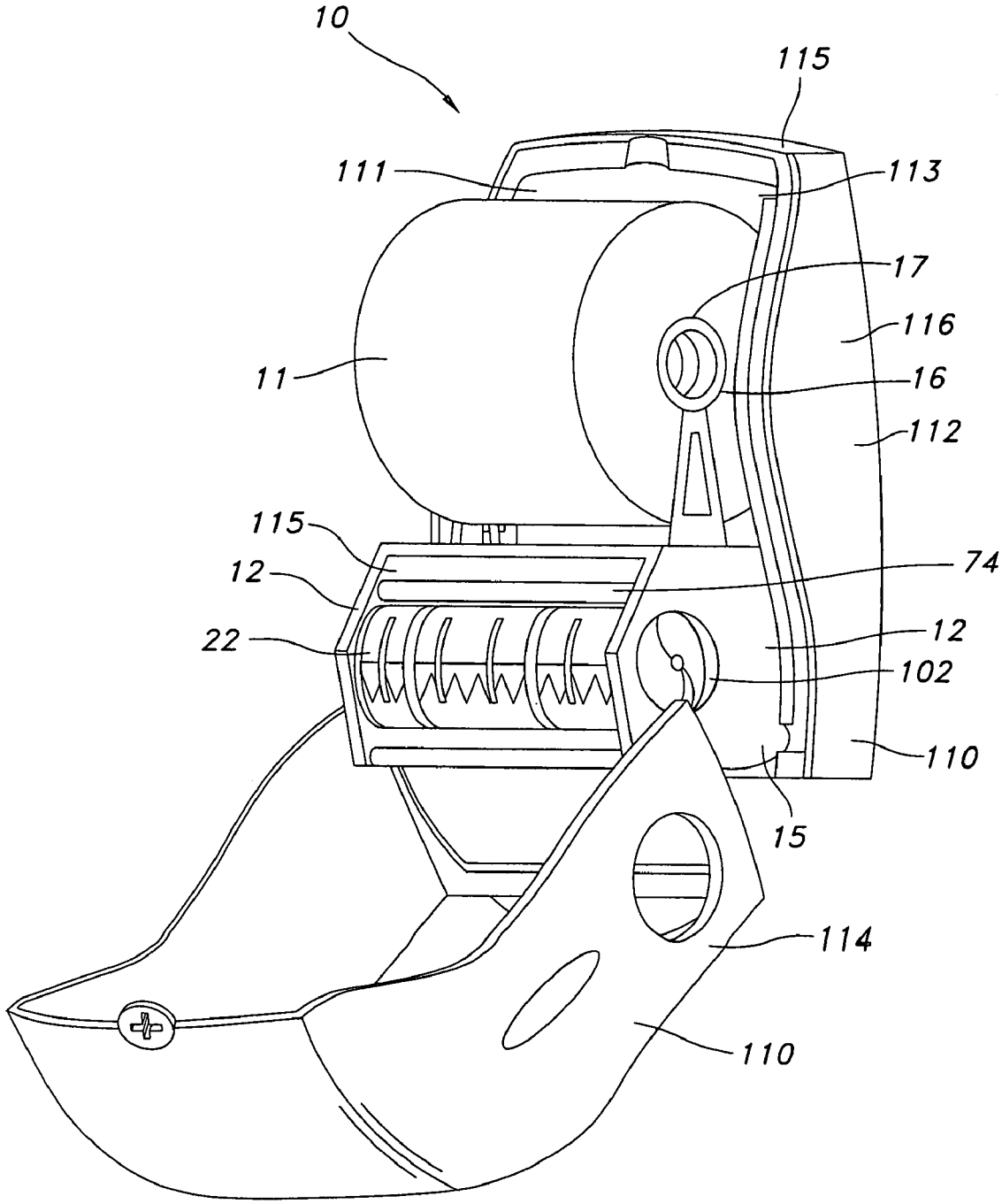
FIG. 2 shows a perspective view of a dispenser of an embodiment of a dispenser according to the present invention, with the front housing in an open position to view the compartment of an embodiment of a dispenser according to the present invention.

Turning to FIGS. 1 and 2, a dispenser 10 within the scope of the present invention will have a dispenser housing 110, also known as a "cabinet". This housing 110 serves to hold and protect the internal workings of the dispenser. Typically, the housing 110 will have a rear housing section 112, also referred to herein as the "rear housing", and a front housing section 114, also referred to herein as the "front housing". The rear housing may have a rear wall 113, top wall 115, sidewalls 116 and a bottom wall 117. Generally, the front housing 114 may be pivotally connected to the rear housing 112 or may be removable from the rear housing 112 in order to service or refill the dispenser 10. As is shown in FIG. 2, the front housing 114 is pivotally connected to the rear housing 112 near the bottom wall 117 of the rear housing 112. In alternative embodiments of the present invention, which are not shown in the drawings, the front housing 114 could be pivotally mounted to one of the sidewalls 116 or to the top wall 115 of the rear housing. Alternatively, the front housing 114 could be completely removable from the rear housing.

The rear housing section 112 provides means for attaching the dispenser 10 of the present invention to a vertical surface, such as a wall. Generally, the rear wall 113 of the rear housing 112 will be used to attach the dispenser 10 to a vertical surface, such as a lavatory wall, kitchen wall and the like, in the case that the dispenser 10 is a paper towel dispenser. That is, the rear 113 wall also serves as the mounting means for the dispenser 10. Any known attachment means can be used to attach the dispenser of the present invention to a vertical surface, including screws, adhesives, combinations thereof and the like.

The housing 110 of the dispenser may be formed from a wide variety of materials and is not limited in its construction. Generally, the materials used to prepare the housing should be selected on the basis of durability, providing impact resistance and wear and tear during normal usage. For example, the housing may be prepared from metal, plastic or combinations thereof, so long as the housing is durable. It is also noted that the front housing section 114 and the rear housing section 112 may be prepared from different materials. In addition, the dispenser housing 110 of the present invention may have any shape, configuration, color or other aesthetic appearance.

The housing 110 of the dispenser 10 forms an internal compartment 111 which contains the operating mechanisms of the dispenser 10. The operating mechanisms of the dispenser may be located in a dispensing module 12, which may be operatively mounted and secured to the housing 110, as is shown in FIG. 2. Generally, the dispensing module 12 is secured to the housing by screws, snaps, dove tail style post and grooves or other suitable mechanical fasteners.

In an embodiment of the present invention, to hold a roll 11 of the web material 13 that is to be dispensed from the dispenser, a roll holder, also referred to as roll supports 14, 16, is operatively associated with the dispensing module 12 to rotatably support a roll of a web material 13. More particularly, now referring to FIGS. 2 and 3, the roll supports generally will include two double-ended arms 14, 16 spaced from one another and roll engagement members 18 at the distal or upper ends 17 of the arms for entering the ends of the roll 11. Roll 11 is directly rotatably supported by the roll engagement members 18. The roll engagement members 18 may include a support roller (not shown).

The roll support arms 14, 16 may be pivotally connected to dispensing module 12 by pivot connectors 20. The pivot connectors 20 are located near the lower end 19 of each roll support arm 14, 16. The pivot connectors allow the roll support arms 14, 16 to be moved outwardly so that the engagement members 18 can be inserted into the ends of the roll 11 of web material 13. Generally, the weight of the roll 11 of web material 13 will exert forces on the arms 14, 16 continuously urging the engagement members 18 of the arms 14, 16 toward one another and toward the roll of paper toweling. Alternately, roll support arms, 14, 16, may be formed to be inwardly biased toward the roll 11 and be formed from a flexible material, such as plastic such that they may be spread to load the roll of material and when released move back in toward the roll 11 to maintain engagement members 18 in contact with the roll of material 11. This prevents dislodgment of the roll 11 from the roll engagement members 18 during dispensing of the web material from the dispenser. The roll 11 of web material 13 may optionally have a roll core (not shown) in which the roll engagement members 18 engage rather than the web material 13. This core may also function as a support roller for the roll 11.

In an alternative embodiment of the present invention, the roll support arms may be pivotally connected to the rear housing 112 rather than the dispensing module 12. Generally, when attached to the rear housing 112, the roll support arms function in a similar manner, as is described above.

Figure 3:
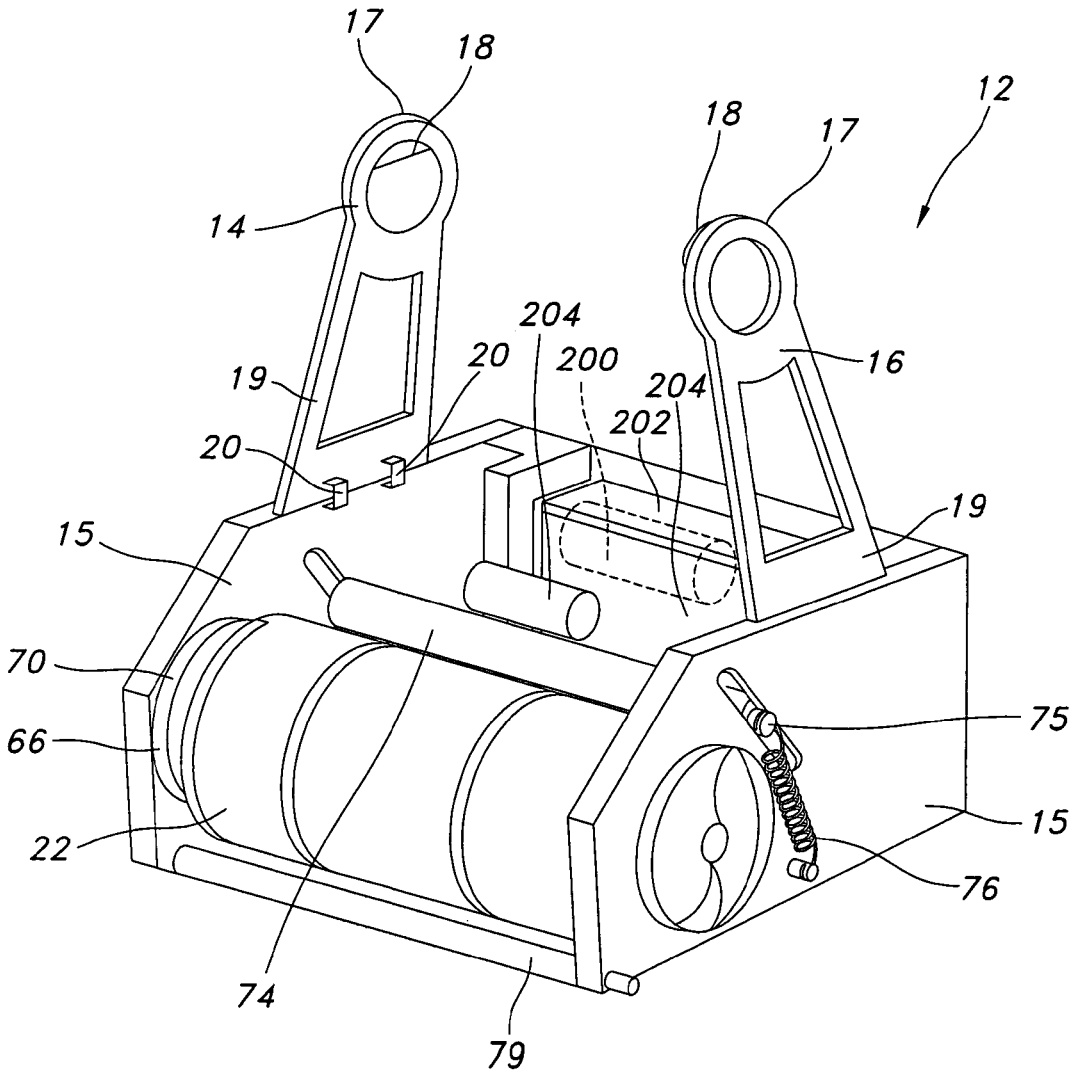
FIG. 3 shows a side perspective view of a dispensing module with rollers present, wherein the dispensing module is shown outside the housing.
Figure 4A:
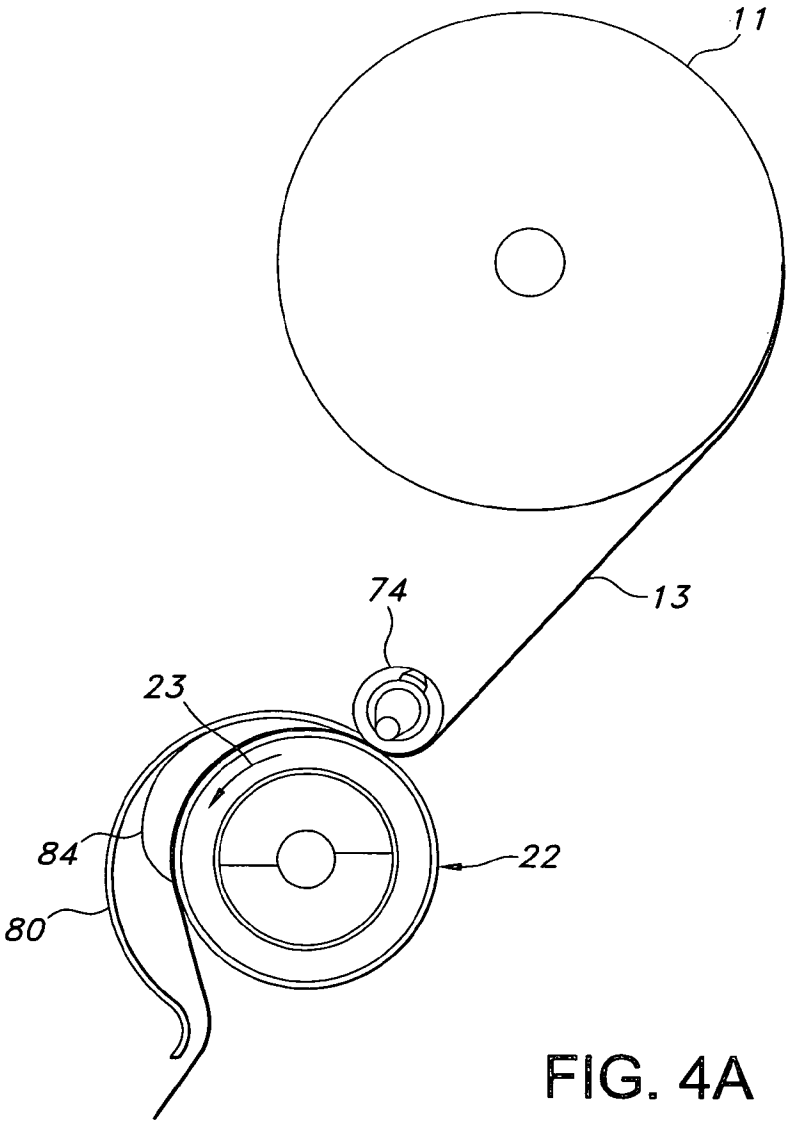
FIGS. 4A and 4B each show the web material fed from the roll to the actuator roller.
Figure 4B:
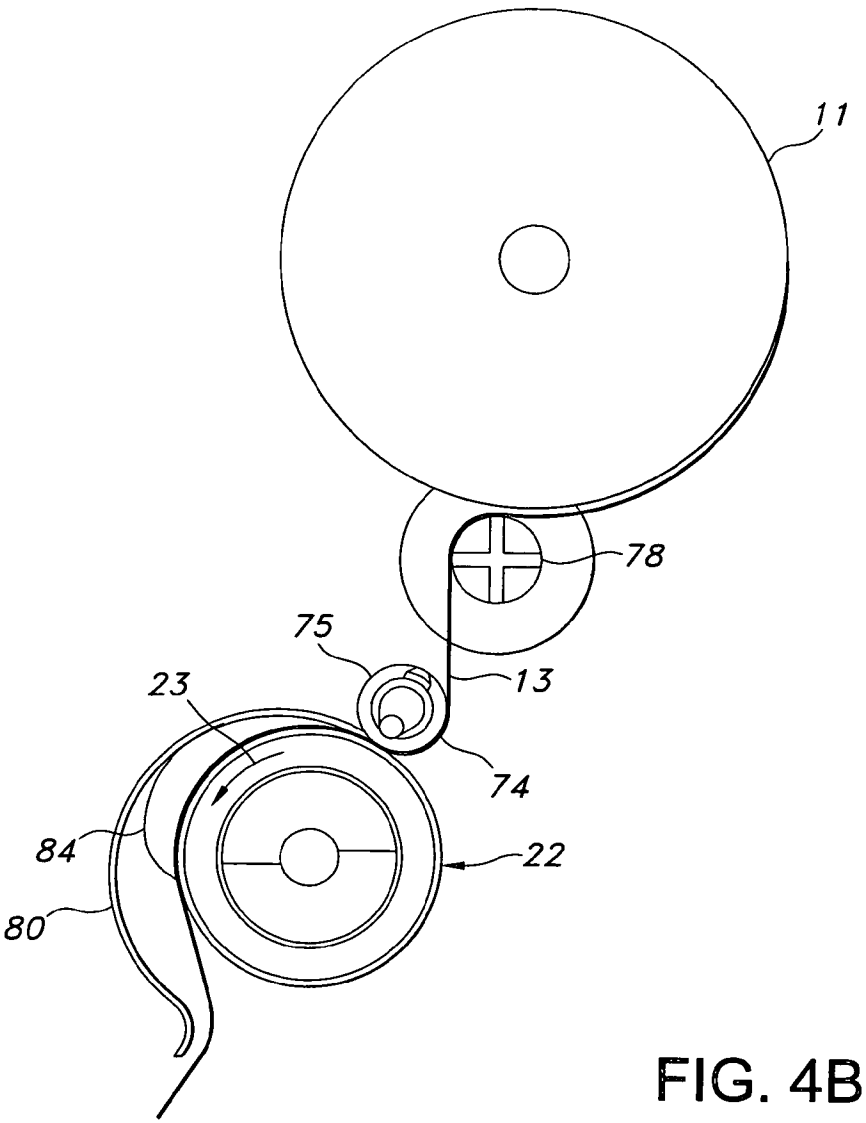

A dispensing actuator roller 22 is rotatably mounted within the compartment 111. The actuator roller 22 generally has a cylindrically-shaped outer peripheral portion and is rotatable in a predetermined direction of rotation. Generally the dispensing actuator roller 22 is mounted within the dispensing module 12, as is shown in FIGS. 2 and 3. The actuator roller 22 is spaced apart from the roll support arms 14 and 16, such that roll 11 of the web material 13 is fed from the roll over the actuator roller 22, as is shown in FIG. 4A or 4B.

The actuator roller 22 will be described below, and will be described as having many different features. It is intended that these features are described as embodiments that can be used to prepare a dispenser within the scope of the present invention and are not intended to limit the actuator roller to one having each and every one of these features. These features are intended to be merely exemplary of features that may be present on the actuator roller 22.

Figure 6:
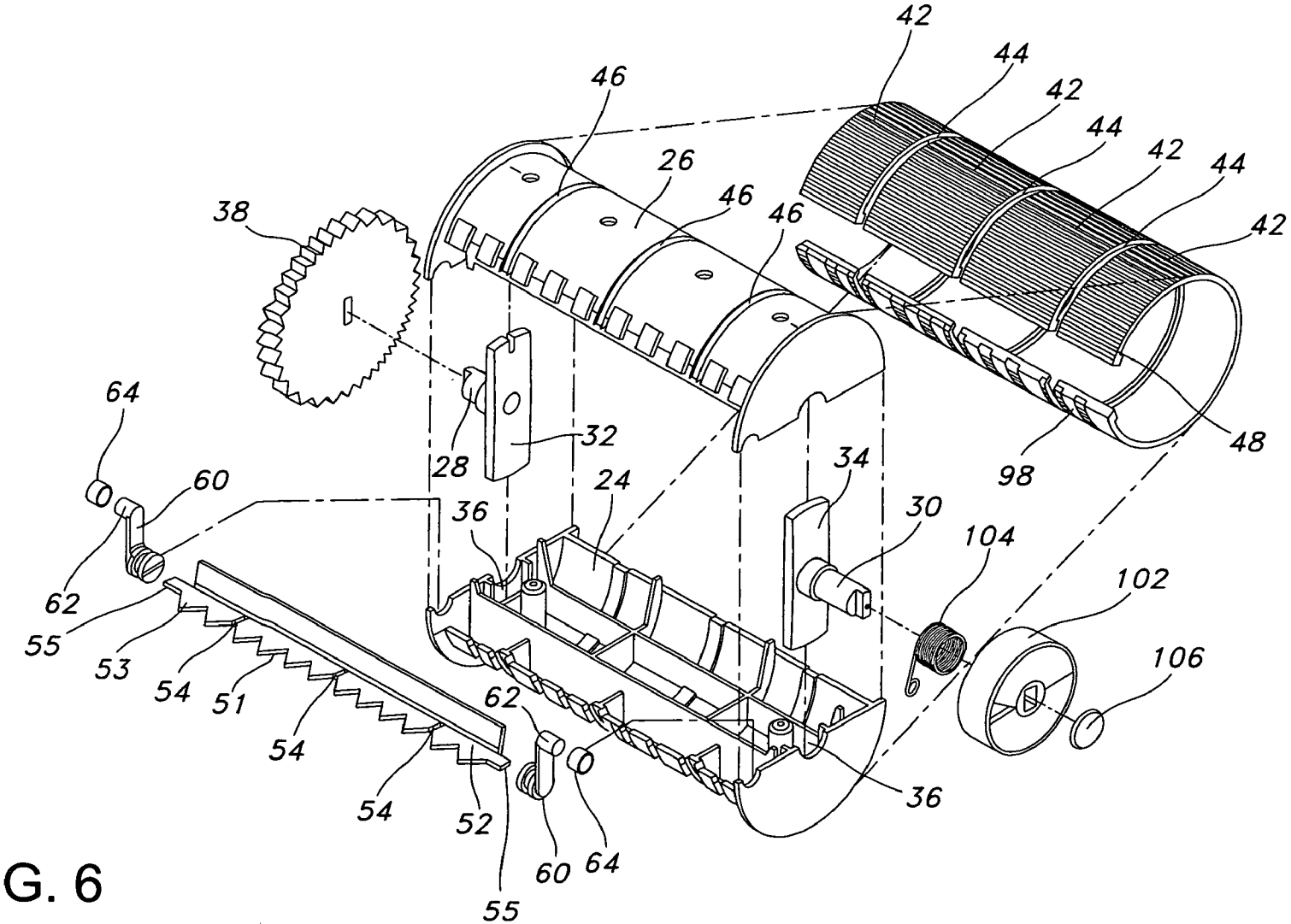
FIG. 6 shows an exploded view illustrating the cutting blade in the actuator roller of an embodiment of a dispenser according to the present invention.

In one embodiment of the present invention, as can be seen in FIG. 6, the actuator roller 22 may optionally be prepared as two roller halves 24, 26 which are assembled together. Alternatively, the actuator roller 22 may be prepared as a single piece or may be prepared from more than two pieces. Shafts 28, 30 may be attached to mounting plates 32, 34, respectively, the mounting plates inserted in recesses 36 located at the ends of the roller halves 24, 26 to lock the shafts 28, 30 in place. This will cause the shafts 28, 30 to rotate with the rest of the actuator roller 22 structure. In an alternative embodiment, shafts 28 and 30 may be prepared as a single shaft which extends through the entire length of the actuator roller 22. The shaft or shafts 28, 30 serve to rotatably mount the actuator roller 22 in the dispensing module 12. Generally, the shafts are located along the center axis of the actuator roller 22 so that the actuator roller rotates evenly when rotated. An actuator roller drive 38 may be connected to the distal end of shaft 28. Alternatively, the actuator roller drive may be located on the proximate shaft 30. In essence, it is not critical to the present invention on which shaft the roller drive 38 is located. Alternatively, the roller drive would be one of the end plates 40 which are described below. The actuator drive roller 38 serves to transfer the rotation force provided by a motor 206 to the actuator roller 22. The actuator roller drive 38 may be a gear, as shown in FIG. 6, or may be any other known structure which will enable a motor or another drive to rotate the actuator roller 22.

Generally, the ends of actuator roller 22 may have circular end plates 40 (see FIG. 5A) which form central openings or apertures 36 accommodating the shafts 28, 30. The cylindrically-shaped outer portion of the actuator roller 22 may include strips of a material 42, which is generally a material such as rubber or plastic that provides a fairly high coefficient of friction. Alternatively, the actuator roller 22 may be prepared from a material which has a fairly high coefficient of friction. By having a fairly high coefficient of friction, the actuator roller will be provided with the ability to contact and hold the web material 13, as it is threaded over the actuator roller 22 and during operation of the dispenser 10. In one embodiment of the actuator roller 22 usable in the present invention, the strips of material 42 are wrapped about the assembled actuator roller halves 24, 26. These strips of material 42 may be applied to the assembled actuator roller to define parallel, spaced channels 44. More particularly, the strips 42 may be located adjacent double ribs 46 formed on roller halves 24, 26 to form the channels. The strips of material 42 do not need to extend all the way about the assembled roller halves. Any suitable means may be employed to secure the strips of material to the roller halves. In one embodiment, the strips 42 may be coated on the roller halves 24, 26, adhesively applied to the roller halves 24, 26 or mechanically attached to the roller halves 24, 26.

The actuator roller 22 may also optionally have a pivotally mounted cutter blade 52 housed within the actuator roller. The cutter blade 52 typically will have a plurality of triangular-shaped teeth 53 along an edge 51 thereof. Cutter blade 52, in this configuration is pivotally connected to the actuator roller 22, in particular about a pivot point located near an outer portion of the cylindrically-shaped actuator roller 22. By having the cutter blade 52 pivotally mounted in the actuator roller 22, the cutter blade 52 can be designed to extend outward from the actuator roller to cut the web material 13 into an individual sheet for use by a user at a certain point in the rotation of the actuator roller 22.

In addition, a plurality of recesses 54 may extend inwardly from the teeth 53 and between sets of teeth 53. These recesses generally align with the channels 44 in the actuator roller 22. That is, the cutter blade teeth 53 do not extend from the actuator roller 22 in the channels 44 found in the actuator roller. Cutter blade 52 has cam followers 60 attached to each end 55 of the cutter blade 52. Optionally, each cam follower 60 has a cam follower arm 62 and a roller 64 positioned on the follower arm 62, as is shown in both FIGS. 5A and 6. The rollers 64 aid in prevention wear of the cam follower 60 or follower arm 62. Each roller 64 is located externally of an end plate 40 and rides in a channel 66 of each cam 70 (shown in FIG. 3). Cams 70 are located at both ends of the dispensing module frame 15. The rollers 64, if present, or the cam follower arms 62 are positioned in the cam and follow the cam 70 during rotation of the actuator roller 22

Figures 5A, 5B:
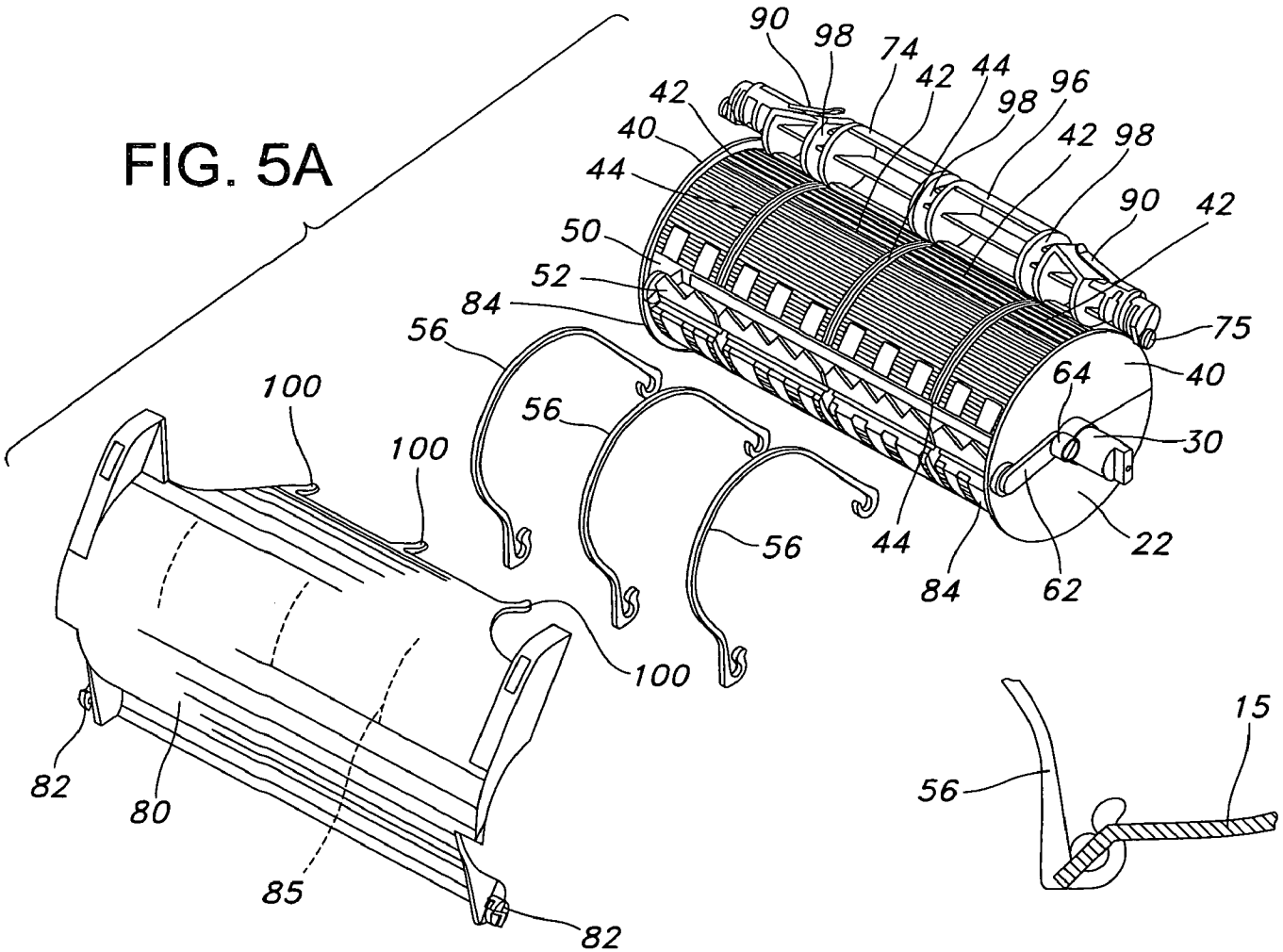
FIG. 5A shows an exploded view illustrating selected components of the apparatus
FIG. 5B shows an enlarged side view illustrating a portion of a guide clip element of the dispenser connected the dispensing module usable in an embodiment of a dispenser according to the present invention.

Channels 44 in the actuator roller 22 may be provided to accommodate a plurality of guide clips 56. The guide clips remain stationary during rotation of the actuator roller 22, and are present to guide the web material 13 from the roll 11 onto the actuator roller 22. The guide clips 56 may be prepared from a variety of materials including metal and plastic type materials. The guide clips 56 are slightly narrower than the channels 44 in the actuator roller 22 and are spaced away the channels 44 in the actuator roller 22 so that the actuator roller 22 will freely rotate on its axis. The guide clips 56 may be generally configured to have a hook-like configuration, as is shown in FIG. 5B, which allows the guide clips 56 to attach to the dispensing module frame 15.

A guide roller or tensioning device 74 may be also mounted in the dispensing module frame 15. Generally, the guide roller or tensioning device will be rotatably mounted in the dispensing module frame 15. The guider roller 74 or tensioning device will serve to guide the web material 13 from the roll 11 to the actuator roller 22, as is shown in FIG. 4A. This guide roller or tensioning device 74 may be positioned next to the actuator roller 22 and can be biased against the actuator roller using a biasing device 76 such as a spring, o-ring bands and the like. Generally, the biasing may be accomplished by attaching the biasing device to the end 75 of the guide roller or tensioning device 74 to the dispensing module frame 15. The guide roller or tension device 74 will generally be cylindrical in nature.

During operation of the actuator roller, it is desirable that the guide roller or tensioning device 74 not contact the cutter blade 52 which may be present in the actuator roller 22. Contact between these elements may result in damage to the cutting blade 52 or the guide roller or tensioning device 74. Damage to one or both of these elements may result in unwanted damage to the web material 13 or make the dispenser 10 unusable for its intended function. To prevent this unwanted interaction between the cutting blade and guide roller or tensioning device 74, the guide roller or tensioning device ends 75 are positioned in slots 88 located in both sides of the dispensing module frame 15. This will allow the guide roller or tensioning device 74 to be displaced by some mechanism as the cutter blade 52 of the actuator roller 22 becomes adjacent to the guide roller or tensioning device 74. One way to cause the guide roller or tensioning device 74 to be displaced is to have protrusions 85 located on the actuator roller 22. One possible location for these protrusions is on the ends 40 of the actuator roller 20, as is shown in FIG. 5A. Generally, these protrusions 85 will be located near the cutter blade 52. However, other methods of displacing the guide roller or tensioning device 74 may also be used without departing from the scope of the present invention. Alternately, one or more guide or tensioning rollers 74 may be configured in a segmented manner wherein segments in contact with actuator roller 22 pass between the teeth 53 on cutter blade 52 and do not contact the cutter blade. The protrusions 84, may serve as web control members 84 which are describe below.

The dispenser 10 of the present invention may also have a guiding plate 80 which is employed to cover the actuator roller 22 and to provide guidance to the web material 13 being dispensed from the dispenser 10. This guide plate 80 may be pivotally mounted to the dispensing module frame 15 using pivot pins 82. Alternatively, the guide plate 80 may be removably mounted without the use of pivots. By having the guide plate pivotally or removably mounted to the dispensing module frame 15, the guide plate 80 may be removed for servicing the actuator roller 22, cutting blade 52 or other parts of the dispensing mechanism. The guide plate may also be provided with fingers 100 which extend over the channels 44 in the actuator roller 22. As is shown in FIGS. 5A and 4A, the guiding plate 80 may also have web control members 84 which cause the web material 13 to remain in contact with the actuator roller 22 as the cutter blade 52 is extended from the actuator roller 22. The web control member 84 may function the same as the protrusions 85 described above. The web control members 84 are positioned over the guide clips 56 so that they will come into contact with the guide clips 56. This will prevent the web control members 84 from becoming damaged during use of the dispenser, since the teeth 53 of the cutter blade 52 are not present in the channels 44 where the guide clips 56 are positioned.

The dispenser of the present invention also has a power supply 202 which is capable of powering a motor 206, and a motor activation means 208. The motor activation means 208 completes a circuit between the power supply 202 and the motor 206, causing power to be supplied from the power supply 202 to the motor 206, activating the motor.

As mentioned, a power supply 202 may be contained within the compartment of the dispenser 111 or the housing 110. The power supply 202 stores and supplies power to the motor and any other control circuitry present in the dispenser. The power source 202 may include a battery compartment 203 for disposable DC batteries 204. Alternatively, the power supply may be a closed system which requires that the entire power supply be replaced as a single unit. Although not shown in the figures, an AC to DC adapter may be utilized to provide an alternate source of power to the dispenser 10. This embodiment may be particularly useful wherein the dispenser 10 is mounted in close proximity to an AC outlet or when it is desirable to power multiple dispensers from a centrally located transformer of suitable configuration and power. The number of batteries used to power the motor will depend on the motor selected for the dispenser. Disposable batteries useable in the present invention include 9 volt batteries, 1.5 volt batteries, such as D-cell or C-cell batteries, or other similar batteries. The exact type of battery selected for use is not critical to the present invention so long as the power supplied to the motor 206 is compatible for the motor. For applications where the dispenser 10 will be used under low usage situations, rechargeable batteries could be used. If the dispenser is to be used in a bright light situation, the batteries could be solar rechargeable batteries. The power supply compartment 200 may be configured to be positioned in the dispensing housing frame, as is shown in FIG. 3, or may be attached to the rear housing 112. The location of the power supply compartment 200 is not critical, but should be located such that the power supply 202 can be easily replaced, when needed. Also the location of the power supply compartment should be selected that power supply compartment does not interfere with the roll of the web material to be dispensed from the dispenser or other operation portions of the dispenser.

Figure 14:
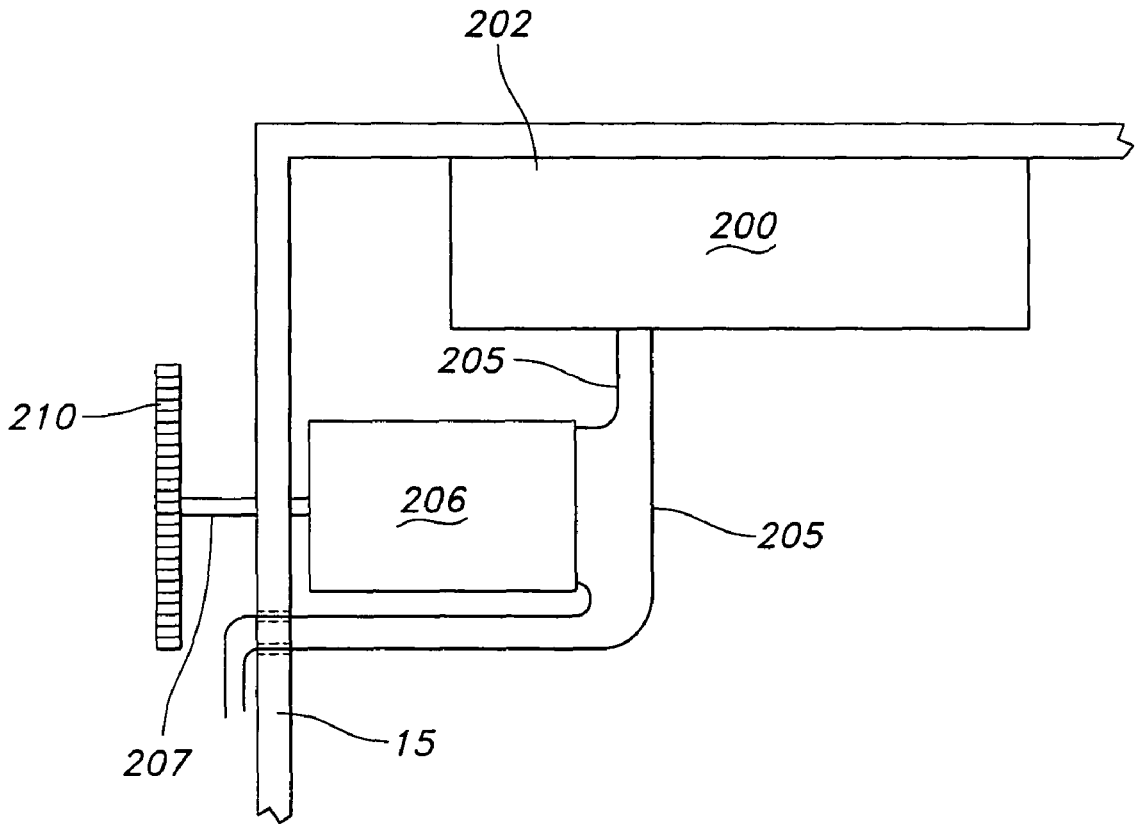
FIG. 14 shows a partial top view of the dispenser module containing the power supply, motor and wires.

The motor 206 is also mounted within the compartment 111 of the dispenser 10. The motor is electrically connected to the power supply 202 and a motor activation means 208. The motor activation means 208 will complete a circuit causing the power to be supplied from the power supply 202 to the motor 206, activating the motor. Generally, any motor that is electrically activated may be used. Typically, the motor may be a direct current (DC) motor, generally in the 3 volt to 12 volt range. Larger or smaller motors may also be used and it is within the skill of those skilled in the art to select an appropriately sized motor. A typical motor usable in the present invention will have a shaft 207 extending from one end of the motor as is shown in FIG. 14, or a shaft may extend from both ends of the motor. Generally, the motor may be mounted in the dispensing module frame 15, using any suitable means known to those skilled in the art.

Figure 15:
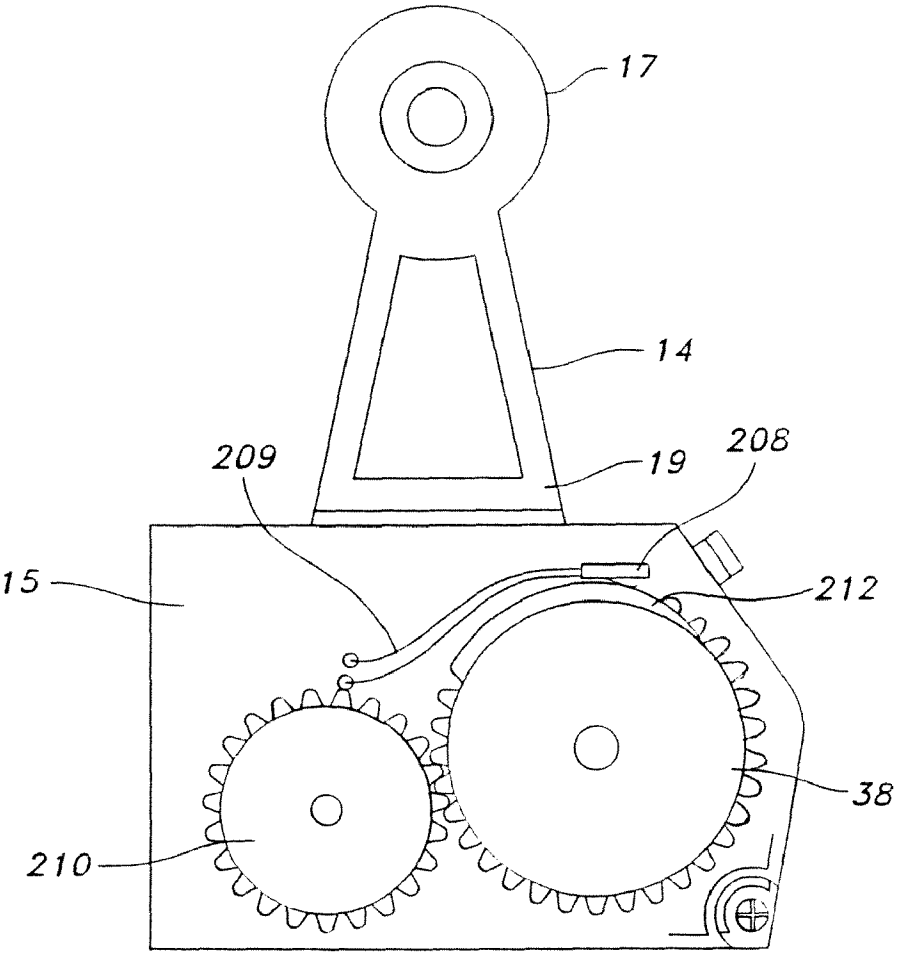
FIG. 15 shows a left side facing the dispenser of a frame structure which is useable in an embodiment of a dispenser according to the present invention.

The motor activation means 208 is electrically connected or wired to the power supply 202 and the motor 206 using circuitry or wiring. Suitable motor activation means includes mechanical switches, optical switches, or any other means of making an electrical connection know to those skilled in the art which could be used to activate the motor 206 with the power supply 202. One particular motor activation means includes a spring loaded switch 208, as is shown in FIG. 15.

The motor 206 is engagingly connected to the actuator roller 22. Any means to engage the motor 206 to the actuator roller 22 may be used, so long as the actuator roller 22 can be easily manually operated. Suitable engagement means includes having the motor directly connected (not shown) to the actuator roller 22, having a belt or chain engage the actuator roller (not shown), using a motor drive wheel 210 located on the motor shaft 207 to engage the actuator roller 22 (not shown) or using a motor drive wheel 210 to engage the actuator roller drive 38, as is shown in FIG. 15. Any of these methods may be used; however, the method of FIG. 15 has some advantages over the other methods mentioned.

Figure 16A:
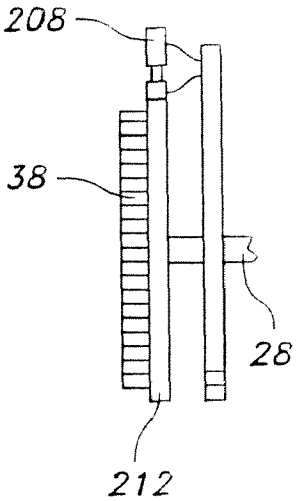
FIGS. 16A and 16B show one embodiment of a method to activate the motor of the dispenser which may be used the present invention.
Figure 16B:
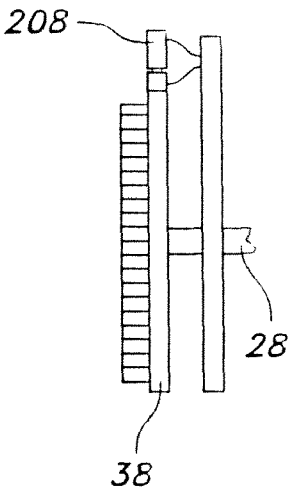

In one embodiment of the present invention, the motor may be activated by a spring loaded switch 208 located adjacent the actuator roller drive 38. The actuator roller drive 38 may have a raised portion 212, which contacts the switch 208. When the raised portion 212 is in contact with the switch 208, as is shown in FIG. 16A, the circuit is completed and power supply 202 supplies power to the motor 206, activating the motor. When the raised portion 212 is not in contact with the switch 208, as is shown in FIG. 16B, the power is not supplied to the motor. It is noted that this is one example of a means to activate the motor 206 and that other similar means to activate the motor 206 can also be used without departing from the scope of the present invention.

The motor drive wheel 210 may be a wheel with a rough surface or a wheel having gear teeth that directly (shown) or indirectly (not shown) contact the actuator roller drive 38. By indirect contact, it is possible that one or more additional rotating members could be located between the drive wheel 210 and the actuator roller drive 38. The actuator roller drive 38 may also have a rough surface which engages the motor drive wheel 210. Alternatively, the motor drive wheel 210 may be a gear, and the actuator drive 38 may also have gear teeth located thereon, as is shown in FIG. 15. When the motor drive wheel 210 is a gear, the actuator drive 38 may also be a gear. The actuator drive 38 may have teeth about the entire circumference of the actuator drive 38, as is shown in FIG. 6 or may have teeth only partially around the circumference of the drive 38, as is shown in FIG. 15.

The dispenser of the present invention may also be provided with additional features such as an emergency feed mechanism. One such mechanism is shown in FIG. 6, and includes a knob 102 which may be mounted on the one of the shafts 28, 30 associated with the actuator roller 22. In the case shown in FIG. 6, the emergency feed knob 102 is located on the shaft 30 opposite the actuator roller drive 38. The knob 102 could be positioned on the shaft 30 such that the knob 102 will not rotate unless engaged. For example, the knob 102 could be mounted with a biasing device (not shown) which would require the user to push the knob 102 toward the actuator roller 22 or, in the alternative, to pull the knob 102 away from the actuator roller 22 in order to engage the knob with the actuator roller 22. Alternatively, the knob 102 could be configured to be continuously engaged with the shaft 30, so that the knob 102 will rotate with as the actuator roller 22. In yet another embodiment of the present invention, if shafts 28 and 30 are connected and form a single shaft running through the entire length of the actuator roller 22, knob 102 and shafts 28, 30 could be made to be movable along the central axis of the actuator roller 22. In that case, the knob 102 and shaft combination could be used to move the actuator roller drive 38 so that the actuator roller drive will not activate the switch or be engaged by the motor drive wheel 210. The knob 102 may be held in place with a cap 106. To prevent a user from turning the knob 102 in a direction opposite the normal direction the actuator roller 22 rotates, a one-way clutch 104 may be provided on the actuator roller. As is shown in FIG. 6, the one-way clutch 104 may be located on one of the shafts 30 and can be associated with the knob 102.

Another feature which may be incorporated in the dispenser of the present invention are clips 90, which may be pivotally connected to the ends of the guide roller or tensioning device 74 and are biased by springs (not shown) to clampingly engage planar surfaces 94 on guide roller or tensioning device 74. The clips 90 aid an attendant to thread the web material through the dispensing mechanism and allow a remainder of a roll of web material to be dispensed, while a new roll of web material is loaded, as is shown in U.S. Pat. No. 6,314,850, which is hereby incorporated by reference in its entirety. Guide roller or tensioning device 74 also has a smoothly rounded wall 96 located between the planar surfaces 94 and may be configured to form peripherally extending grooves 98 which correspond to placement of the channels 44 and guide clips 56. Fingers 100 on guide plate 80 extend into grooves 98.

Other features which may optionally be incorporated into the dispenser of the present invention include an additional guide roller 78, as is shown in FIG. 4B. The additional guide roller may help prevent over spinning of the roll during dispensing and help guide the web material 13 from the roll 11 to the actuator roller. The dispenser of the present invention may also optionally have a dispensing roller 79, located near the dispensing slot 118, as is shown in FIG. 3.

To help understand the operation of an embodiment of a dispenser within the scope of the present invention, attention is directed to FIGS. 7-13. FIGS. 7-13 show a full dispensing cycle of a dispenser within an embodiment of the present invention. Under normal operation of dispenser 10, the user is presented with a tail 121 of the web material 13 projecting through dispensing slot 118 (FIG. 1) located on the bottom front portion of front housing 114. The user grasps the tail 121 of the web material 13 and pulls the tail 121 from the dispenser using a downward force 122, shown in FIG. 8. This downward force 122 causes the actuator roller 22 to start to move in a rotation direction 123 shown in FIG. 7. The cam follower 60 and cutter blade 52 also follow the rotation direction 123.

During rotation of the actuator roller 22, the cam follower arms 62 or cam roller 64, if present, are caused to move along the cam surfaces within the defining channels 66. This in turn will cause the cutter blade 52 to pivot relative to the actuator roller 22. The cutter blade 52 moves between a first position, shown in FIGS. 7 and 8 to a second position, shown in FIGS. 11 and 12. In the first position, the cutter blade 52 lies substantially flat against the actuator roller 22 or to be positioned within the actuator roller 22 with the cutting or toothed edge 53 of the cutting blade 52 positioned closely adjacent to or within the actuator roller 22. In the second position, the cutter blade 52 is disposed at an angle relative to the outer surface of the actuator roller 22, with the teeth 53 thereof spaced from the actuator roller 22. The cutter blade 52, when in the second position, projects from the pivot in a direction generally opposed to the direction of rotation of the actuator roller 22. This is clearly shown in FIGS. 11 and 12.

Figure 7:
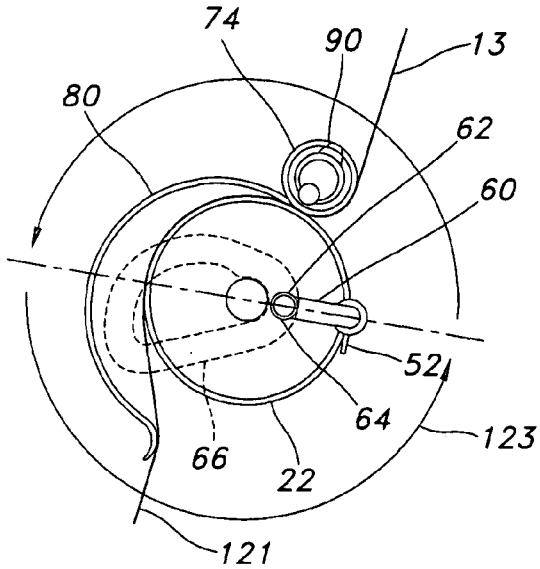
FIG. 7-13 show schematic end views illustrating the cooperative relationships existing between the rotatable actuator roller, cutter blade, cam follower and other structural components of an embodiment of a dispenser within the scope of the present invention during sequential stages of operation of the dispenser. These figures also show a full dispensing cycle of a embodiment of the present invention.

FIGS. 7 through 13 provide an illustration of the action of the cutter blade 52 relative to the actuator roller 22 due to cam actuation. FIG. 7 illustrates by curved arrows 123 the direction of rotation of the actuator roller 22, cam follower 60 and cutter blade 52. FIG. 7 shows the cutter blade 52 in its first position, the position it assumes when the actuator roller 22 is at rest. This is also the initial or rest position for the actuator roller 22, when not dispensing a sheet. The web material 13 from roll 11 is located on and supported by the actuator roller 22, the toweling passing under the guide roller or tensioning device 74 forming a nip with the actuator roller 22. The guide roller or tensioning device 74 may be stationary or may rotate. The guide roller or tensioning device 74 acts to apply pressure to the actuator roller 22 to keep the web material under tension when the web material 13 is being dispensing.

Figure 8:
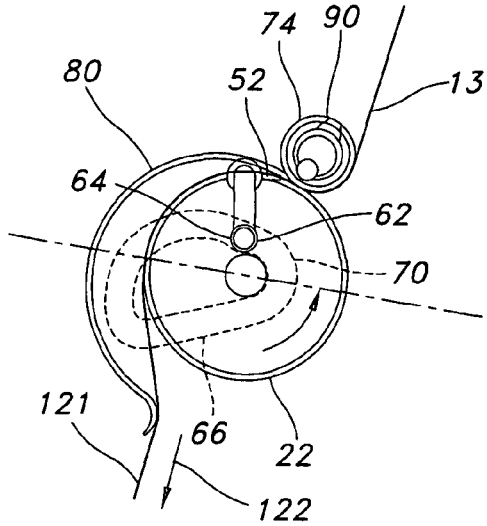
Figure 9:
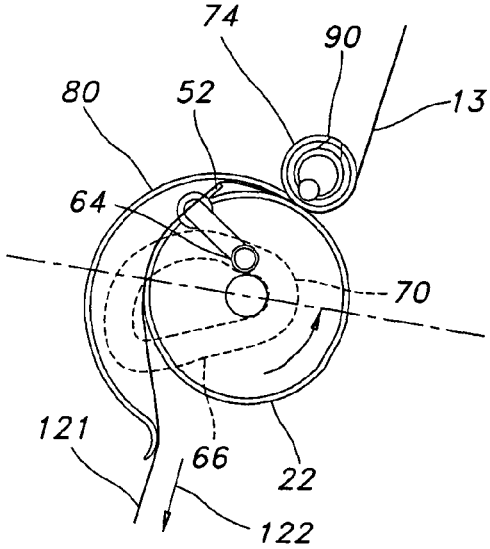
Figure 10:
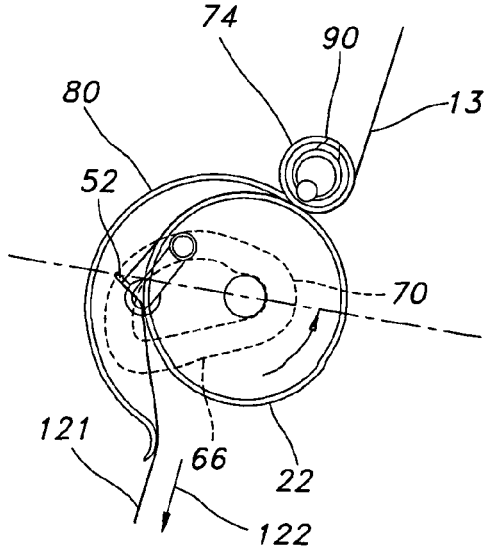
Figure 11:
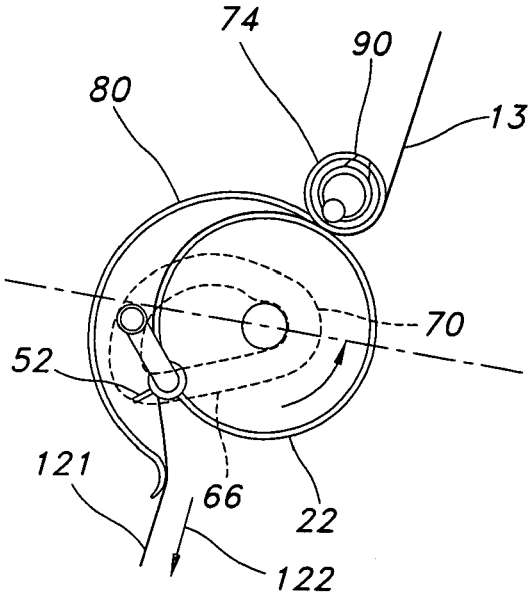
Figure 12:
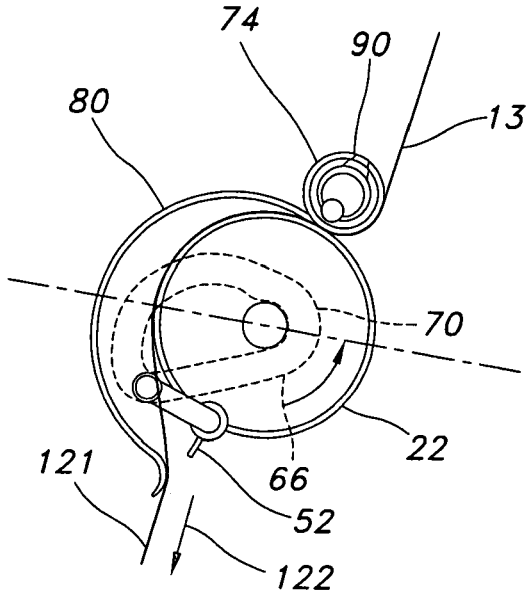
Figure 13:
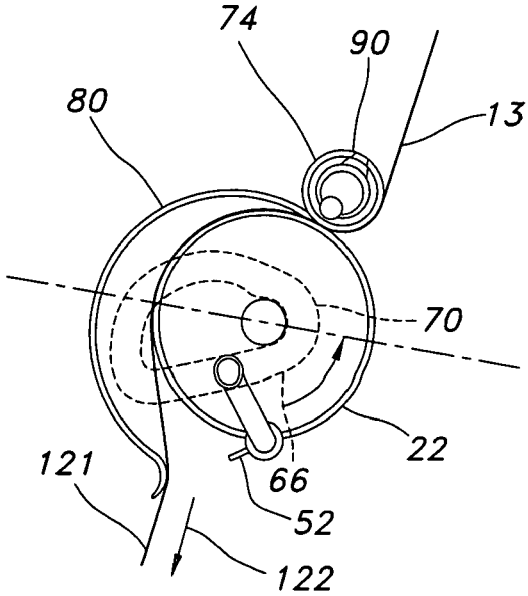

Referring to FIGS. 7 through 12, it can be seen that the cutter blade 52 pivots while the actuator roller 22 rotates during dispensing. The user applies a pulling force 122 by the user grasping the free end 121 of the web material and pulling it in the direction shown in FIGS. 8 through 12. The cutting or toothed edge 53 of the blade 52 engages the underside of the web material on the actuator roller 22 and pushes the web material in an upward direction as shown in FIG. 9. At this point the web material 13 is actually pulled against the teeth 53 of the cutter blade 52. This causes teeth 53 of the cutting blade 52 to begin to sever the web material 13, which will continue to occur during continued rotation of the actuator roller, as is shown in FIGS. 10 and 11. It is noted that the web control members 84, shown in FIG. 4A, may also aid in keeping the web material 13 in contact with the teeth 53 of the cutter blade 52. During the dispensing process, tension on the towel is maintained by the user, guide roller or tensioning device 74 exerting force on the web material 13 and the actuator roller 22 to also contribute to web material tensioning. FIG. 11 shows the severing of the web has begun to take place and FIG. 12 shows the sheet 124 being freed from the newly forming tail 121'. At this point, the sheet 124 is removed from the dispenser. FIG. 13 shows the actuator roller returning to its rest position, shown in FIG. 7. As shown in the illustrations of FIGS. 7-13, a full dispensing cycle is one full rotation of the actuator roller 22.

Under normal operation of dispenser 10, the user is presented with a tail of the web material projecting through dispensing slot 24 on the bottom front portion of front housing 22. The user grasps the tail of the web material and pulls the tail from the dispenser. This will cause the actuator roller 22 to start to rotate and will start the roll 11 to start to rotate due to the advancing web material in the dispenser. As the cutter blade 52 starts to extend out of the actuator roller 22, as is shown in FIG. 8 and FIG. 9, the resistance to rotation of the actuator roller 22 increases, requiring more energy to be expended to dispense the web material from the dispenser. It is at this point in the rotation of the actuator roller 22, or just before, that is referred to herein as the first predetermined location in which the motor is powered and is designed to engage, directly or indirectly, the actuator roller 22. Stated another way, the motor is powered and directly or indirectly engages the actuator roller 22 at some point between the rest point, shown in FIG. 7 and the extension of the cutter blade 52, shown in FIG. 9. The motor continues to operate and drive the actuator roller 22 until the web material 13 has been severed and a sheet 124 has been dispensed. Typically, the motor will operate to the point shown in FIG. 12 or shortly thereafter which is referred to herein as the second predetermined location. This is because relatively low force is needed to have the actuator roller 22 return to the rest position, shown in FIG. 7 from the sheet dispensing position shown in FIG. 12, and/or the momentum of the rotation of the actuator roller 22 will cause the actuator roller 22 to continue in its motion to the position shown in FIG. 7. Alternatively, the motor 206 may operate until the actuator roller 22 has returned to its initial starting position shown in FIG. 7, which is also called the rest position.

If the motor is activated too soon, the motor will need to overcome the inertia of the roll 11 at rest. This will cause an increase in power usage, which may result in an increase in battery usage, if batteries are used as the power supply. By having the user pull the tail 121, the user starts the roll 11 of the web material 13 in motion, overcoming the inertia present in the roll 11. This will result in a longer battery life and less energy being used to dispense the sheet of the web material from the dispenser.

If the motor is deactivated too late, the momentum of the actuator roller 22 could possibly cause the actuator roller 22 to continue past its rest position shown in FIG. 7, such that motor would be caused to reactivate. Generally, having the motor disengage the actuator roller or shut down at or about the time sheet is dispensed will generally provide enough rotational momentum to the actuator roller to return the rest position, shown in FIG. 7. Of course, depending on the size of the motor and the rotational characteristics of the actuator roller 22, the actual motor disengagement or shut off may have to be modified to ensure that the actuator roller 22 returns to the rest position, and a leading edge or tail is positioned for grasping in subsequent uses, as is shown in FIG. 7.

In typical operation of the dispenser, the first predetermined location, where the motor is powered, is generally between one-quarter and one-half of one full rotation of the actuator roller from a rest position. The second predetermined location, where to power is removed from the motor, is generally between one-third of one full rotation of the actuator roller from the rest position and one full rotation of the actuator roller from the rest position. Of course, the second predetermined location must be after the first predetermined location. Generally, the first predetermined location in the rotational path of the actuator roller is about one-third of one full rotation of the actuator roller from the rest position and the second predetermined location is between about two-thirds of one full rotation of the actuator roller from the rest position and one full rotation of the actuator roller from the rest position.

In one embodiment of the present invention, shown in FIG. 15, the motor activation means 208 may be a spring loaded switch which is mounted on the dispensing module frame 15 adjacent the actuator roller drive 38. As is mentioned above, the actuator roller drive has a raised portion or protrusion 212, which will contact the switch. When this contact is made between the raised portion 212 of the actuator roller drive 38 and the switch, the motor 206 is activated by the power supply 202. When the switch comes into contact with the portion of the actuator roller drive which is not raised, the switch does not make contact, thereby causing the motor 206 to deactivate. The raised portion 212 on the actuator roller drive 38 should be located in relationship to the switch such that a connection is made by the switch when the actuator roller 22 is in about a position shown in FIG. 8, and the connection is broken when the actuator roller 22 is in about a position shown in FIG. 12.

While one exemplary embodiment is described herein, it should be understood that various configurations of cutter blades, blade drive mechanisms and the like are possible such that the blade is urged out at an earlier or preferably later point in the dispense cycle. But no matter how configured, the dispenser of the present invention does not need the motor to drive the actuator roller 22 for the entire dispensing cycle. In the description dispenser given above, the user supplies the dispensing energy, by pulling on the sheet, for approximately one-fourth to about one-half of the full dispensing cycle. Conversely, the motor supplies power for approximately one-half to about three-quarters of the full dispensing cycle. Generally, in the above-described embodiment of the present, generally the user supplies energy for about one-third of the dispensing and the motor supplies energy for about two thirds of the dispensing cycle. It is noted that the energy supplied by the motor may be provided by having the motor run for about one-third of the full cycle. This description should not be considered to be limiting since it is possible to configure the cutter blade and related drive means such that the users supplies the energy for one half or more of the cycle thereby requiring less power from the power supply per cycle.

In the present invention, the first predetermined location is when the resistance to rotation begins to increase. Generally, this is when the cutter blade 52 starts to extend to cut the web. It is at this point, the motor 206 should be activated to drive the actuator roller 22. After the cutter blade 52 cuts the web and starts to retract, the energy needed to finish the full cycle begins to decrease. The motor is then deactivated at a point that the motor adds enough energy to the actuator roller 22 that the actuator roller continues to turn and return to a rest position, advancing a new tail or leading edge of the web material from the dispenser so that the dispenser is ready for the next dispensing event.

In the operation of the dispenser of the present invention, typically the user will provide energy for about one-forth to about one-half of the full dispensing cycle or full rotation of the actuator roller. The motor is then powered for about one-half to about three-fourths of the dispensing cycle, then deactivated. Next, the energy supplied by the motor is generally enough to continue the dispensing cycle without the user supplying energy or the motor supplying energy any additional energy. This occurs for about one-quarter to one half of the full dispensing cycle. As an example, the user pulls the tail of the web for about the first one-third of the full dispensing cycle, the motor 206 is engaged for the next one-third of the dispensing cycle and the motor is deactivated for the next one-third of the dispensing cycle. Generally, after the motor 206 is deactivated, the energy supplied to the actuator roller 22 from the roller while the motor is engaged with the actuator drive 38 is usually enough for the actuator roller 22 to continue to rotate back to the rest position. However, it should be noted that the motor, if necessary, may continue to drive the actuator roller to its rest position.

In one particular embodiment of the present invention, the dispenser for dispensing sheets of a paper towel.

The advantages of the dispenser of the present invention include the ability to use a web material with a lower tensile strength, since less pulling force is needed to dispense a sheet of the web material from the dispenser. This will save cost with respect to making the web material to be dispensed from the dispenser, since fewer raw materials will be needed to make the web material to be dispensed. Further, paper towels with a lower tensile strength are generally softer and more absorbent than paper towels with higher tensile strength.

In addition, the dispenser of the present invention provides advantages over conventional electronic dispensers in that the user provides the initial energy to start the dispensing process before the motor is activated to assist the user in dispensing the sheet material from the dispenser, thereby requiring lower power consumption on each dispensing event. The present invention does not need a power supply to power sensors to detect a user requiring a sheet of the web material. As a result, the battery life of the batteries used in the dispenser of the present invention may be considerably longer than other electronic dispensers.

In a further embodiment of the present invention, dispenser could be provided with a web material identification means. (Not shown). Examples of such means are described in U.S. Patent Application Publication 2005/0145745 to Lewis et al., which is hereby incorporated by reference in its entirety. By having a web material identification means within the dispenser, the dispenser could identify whether or not the web material being dispensed from the dispenser is a low tensile strength material. If the web material is a low tensile strength material, the motor will be activated as described above. If the material is identified as a material other than a low tensile strength web material, the dispenser could be set-up such that the motor would not be activated as described above and the user would impart all of the energy to dispense the sheet of the material.

Generally, the web material identification means may be reader or scanner which reads data from identification on the web material 13 or on a core of the web material roll 11. In this case, the identification may comprise a label, a logo, a bar code, a magnetic strip, a radio frequency identification device (RFID) such as a "smart" tag or chip, or a hologram on the roll of sheet material. In one embodiment of this additional aspect of the invention, the identification on the roll of web material is encoded, and the dispenser includes a decoder for decoding the encoded data. Alternatively, the web material identification may comprise an infrared emitter/detector circuit which is arranged to emit infrared light into the core of the web material roll, and to detect reflection of the light off reflective identification on the core of the roll 11. These types of identification means are described in more detail in U.S. Patent Application Publication 2005/0145745.

Although the present invention has been described with reference to various embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. A dispenser for dispensing sheets from a roll of a web material comprising:

a housing which forms a compartment;

a holder for supporting a roll of a web material within the compartment;

a cutting blade contained within an actuator roller, the actuator roller having a rotational path, the cutting blade being extendable from the actuator roller at a first predetermined location in the rotational path of the actuator roller and retractable at a second predetermined location in the rotational path of the actuator roller, wherein the cutting blade is extended from the actuator roller to cut the web material to form a sheet of the web material to be dispensed from the dispenser;

a motor engagably connected to the actuator roller;

a motor activation means, wherein the motor activation means activates the motor at or near the first predetermined location of the rotational path and deactivates the motor at or near the second predetermined location of the rotational path.

2. The dispenser according to claim 1, further comprising a power supply connected to the motor.

3. The dispenser according to claim 1, wherein the motor activation means comprises a switch.

4. The dispenser according to claim 1, wherein the actuator roller comprises at least one shaft extending from one end of the central axis of the actuator roller, and an actuator roller drive is positioned on the shaft.

5. The dispenser according to claim 4, wherein the actuator roller drive comprises a raised portion and an unraised portion, the raised portion being designed to contact the motor activation means to activate the motor and the unraised portion contacts the motor activation means in a way to deactivate the motor.

6. The dispenser according to claim 5, wherein the motor comprises a shaft, the shaft has a motor drive wheel attached to the shaft.

7. The dispenser according to claim 6, wherein the actuator roller drive further comprises a gear structure and the motor drive wheel comprises a gear structure, wherein the gear structure of the motor drive wheel engages the gear structure of the actuator roller drive.

8. The dispenser according to claim 7, wherein the gear structure motor drive wheel directly engages the gear structure of the actuator roller drive.

9. The dispenser according to claim 1, further comprising an emergency feed knob located on the same axis as the actuator roller.

10. The dispenser according to claim 9, wherein the knob is disengaged from actuator roller during normal operation, but is engagable with the actuator roller for emergency feeding.

11. The dispenser according to claim 1, further comprising a roll of web material positioned in the holder.

12. The dispenser according to claim 1, wherein the first predetermined location in the rotational path of the actuator roller is between one-quarter and one-half of one full rotation of the actuator roller from a rest position and the second predetermined location is between one-third of one full rotation of the actuator roller from the rest position and one full rotation of the actuator roller from the rest position.

13. The dispenser according to claim 12, wherein the first predetermined location in the rotational path of the actuator roller is about one-third of one full rotation of the actuator roller from the rest position and the second predetermined location is between about two-thirds of one full rotation of the actuator roller from the rest position and one full rotation of the actuator roller from the rest position.

14. The dispenser according to claim 1, further comprising a web material identification means, which identifies the web material positioned on the holder for supporting the web material.

15. A dispenser for dispensing sheets from a roll of a web material comprising;

a housing;

a compartment positioned within the housing;

a holder for supporting a roll of a web material, the holder located within the compartment;

a dispensing actuator roller rotatably mounted within the compartment, the actuator roller having a rotational path and a rest position;

a cutting blade mounted within the actuator roller, wherein the cutting blade cuts the web material at a predetermined location in the rotational path of actuator roller, and the cutting blade cuts the web material to form a sheet of the web material to be dispensed from the dispenser;

a motor engagably connected to the actuator roller;

a motor activation means to activate the motor, wherein the motor activation means activates the motor at a first predetermined location of the rotational path of the actuator roller between the rest position and the predetermined location in the rotational path of the actuator roller in which the cutting blade cuts the web material and deactivates the motor at a second predetermined location of the rotational path of the actuator roller at or before the rest position, wherein the first predetermined location in the rotational path of the actuator roller is between one-quarter and one-half of one full rotation of the actuator roller from a rest position and the second predetermined location is between one-third of one full rotation of the actuator roller and one full rotation of the actuator roller from the rest position.

16. The dispenser according to claim 15, further comprising a power supply connected to the motor.

17. The dispenser according to claim 16, wherein the motor activation means comprises a switch.

18. The dispenser according to claim 17, wherein the actuator roller comprises at least one shaft extending from one end of the central axis of the actuator roller, an actuator roller drive is positioned on the shaft, the actuator roller drive comprises a raised portion and an unraised portion, the raised portion being designed to contact the motor activation means to activate the motor and the unraised portion contacts the motor activation means in a way to deactivate the motor.

19. The dispenser according to claim 18, wherein the motor comprises a shaft, the shaft has a motor drive wheel attached to the shaft, the actuator roller drive further comprises a gear structure and the motor drive wheel comprises a gear structure, wherein the gear structure of the motor drive wheel engages the gear structure of the actuator roller drive.

20. The dispenser according to claim 19, wherein the gear structure of motor drive wheel directly engages the gear structure of the actuator roller drive.

21. The dispenser according to claim 15, further comprising a web material identification means, which identifies the web material positioned on the holder for supporting the web material.

22. The dispenser according to claim 15, further comprising an emergency feed knob located on the same axis as the actuator roller.

* * * * *